US010952927B2

(12) United States Patent
Mehregany

(10) Patent No.: US 10,952,927 B2
(45) Date of Patent: Mar. 23, 2021

(54) APPARATUS FOR MONITORING THE CONTENT OF A CONTAINER AND METHOD THEREFOR

(71) Applicant: QuantaEd, LLC, San Diego, CA (US)

(72) Inventor: Mehran Mehregany, San Diego, CA (US)

(73) Assignee: QuantaEd, LLC, San Diego, CA (US)

( * ) Notice: Subject to any disclaimer, the term of this patent is extended or adjusted under 35 U.S.C. 154(b) by 55 days.

(21) Appl. No.: 16/422,284

(22) Filed: May 24, 2019

(65) Prior Publication Data

US 2019/0274921 A1 Sep. 12, 2019

Related U.S. Application Data

(63) Continuation of application No. 15/170,121, filed on Jun. 1, 2016, now Pat. No. 10,322,064, which is a (Continued)

(51) Int. Cl.
*A61J 1/03* (2006.01)
*A61J 7/04* (2006.01)
(Continued)

(52) U.S. Cl.
CPC . *A61J 1/03* (2013.01); *A61J 1/00* (2013.01); *A61J 7/04* (2013.01); *B65D 55/02* (2013.01);
(Continued)

(58) Field of Classification Search
CPC ..... A61J 1/03; A61J 7/04; A61J 1/00; A61J 2200/70; A61J 7/0481; A61J 7/02;
(Continued)

(56) References Cited

U.S. PATENT DOCUMENTS 4,616,316 A 10/1986 Hanpeter et al.
4,617,557 A 10/1986 Gordon
(Continued)

FOREIGN PATENT DOCUMENTS

AU 2009238236 A1 12/2009
WO 2008/079090 A1 7/2008
(Continued)

OTHER PUBLICATIONS

"SMRxT Realtime Medication Adherence", 2012-2014, Publisher: SMRxT Inc.; http://smrxl.com/index.php.
(Continued)

*Primary Examiner* — Nasima Monsur
(74) *Attorney, Agent, or Firm* — Kaplan Breyer Schwarz, LLP

(57) ABSTRACT

Methods and apparatus for monitoring the content of a chamber of a container via electrical capacitive tomography (ECT) or acoustic imaging are presented. The three-dimensional volume of the chamber and its content are imaged by developing a map of permittivity or acoustic impedance by (1) applying a stimulus signal between each of a plurality of electrode pairs of a plurality of electrodes that is arranged about the chamber and (2), for each stimulus signal applied, measuring a response signal at each of the remaining electrodes of the plurality. Once the map of permittivity or acoustic impedance is established, the number and type of tablets (or liquid) within the chamber is determined.

31 Claims, 6 Drawing Sheets

Related U.S. Application Data continuation-in-part of application No. 14/879,874, filed on Oct. 9, 2015, now Pat. No. 10,375,847.

(60) Provisional application No. 62/320,234, filed on Apr. 8, 2016, provisional application No. 62/137,988, filed on Mar. 25, 2015, provisional application No. 62/062,291, filed on Oct. 10, 2014.

(51) Int. Cl.
*B65D 79/02* (2006.01)
*A61J 1/00* (2006.01)
*B65D 55/02* (2006.01)

(52) U.S. Cl.
CPC ..... *B65D 79/02* (2013.01); *B65D 2211/00* (2013.01)

(58) Field of Classification Search
CPC ..... A61J 7/0418; B65D 79/02; B65D 55/02; B65D 2211/00; G01N 1/28; G01N 27/026; G01N 2011/0066; G01N 27/221; G01N 2011/0073; G01N 2011/008; G01N 2011/0086; G01N 2011/0093; G01R 27/26; G01R 27/2617; G01R 31/12
See application file for complete search history.

(56) References Cited

U.S. PATENT DOCUMENTS

| | | | | |
|---|---|---|---|---|
| 5,313,439 | A | 5/1994 | Albeck | |
| 5,412,372 | A | 5/1995 | Parkhurst et al. | |
| 5,852,590 | A | 12/1998 | De La Huerga | |
| 6,411,567 | B1 | 6/2002 | Niemiec et al. | |
| 7,028,723 | B1 | 4/2006 | Alouani et al. | |
| 7,081,807 | B2 | 7/2006 | Lai | |
| 7,113,101 | B2 | 9/2006 | Petersen et al. | |
| 7,258,005 | B2 | 8/2007 | Nyce | |
| 7,630,788 | B1 | 12/2009 | Reese | |
| 7,821,404 | B2 | 10/2010 | Walker et al. | |
| 7,928,835 | B1 | 4/2011 | Jovanov et al. | |
| 8,025,149 | B2 | 9/2011 | Sterry et al. | |
| 8,120,492 | B2 | 2/2012 | Scharfeld et al. | |
| 8,152,020 | B2 | 4/2012 | Flowers et al. | |
| 8,583,281 | B2 | 11/2013 | Bear et al. | |
| 8,733,432 | B2 | 5/2014 | Labrecque | |
| 8,762,084 | B2 * | 6/2014 | Gao | G01N 27/228 702/65 |
| 8,878,654 | B2 | 11/2014 | Cohen-Alloro et al. | |
| 8,960,440 | B1 | 2/2015 | Kronberg | |
| 8,963,710 | B2 | 2/2015 | Huang et al. | |
| 9,070,063 | B2 | 6/2015 | Carrender | |
| 2005/0162979 | A1 | 7/2005 | Ostergaard et al. | |
| 2010/0006441 | A1 * | 1/2010 | Renaud | B01L 3/502761 204/643 |
| 2010/0089789 | A1 | 4/2010 | Rosenbaum et al. | |
| 2010/0089791 | A1 | 4/2010 | Rosenbaum et al. | |
| 2010/0094455 | A1 | 4/2010 | Dehlin et al. | |
| 2011/0100862 | A1 | 5/2011 | Turkington et al. | |
| 2012/0024889 | A1 | 2/2012 | Robertson et al. | |
| 2012/0056000 | A1 | 3/2012 | Shores | |
| 2013/0085365 | A1 | 4/2013 | Marashdeh et al. | |
| 2013/0222135 | A1 * | 8/2013 | Stein | A61J 7/0409 340/540 |
| 2013/0236635 | A1 | 9/2013 | Leuenberger et al. | |
| 2013/0285681 | A1 | 10/2013 | Wilson et al. | |
| 2013/0319902 | A1 | 12/2013 | Tufi | |
| 2013/0330684 | A1 | 12/2013 | Dillon et al. | |
| 2014/0055267 | A1 | 2/2014 | Rothschild | |
| 2014/0118010 | A1 | 5/2014 | Fan et al. | |
| 2014/0251850 | A1 | 9/2014 | Huang et al. | |
| 2014/0255899 | A1 | 9/2014 | Poullain | |
| 2014/0341411 | A1 | 11/2014 | Mohindra et al. | |

FOREIGN PATENT DOCUMENTS

| | | | |
|---|---|---|---|
| WO | 2010/045227 | A1 | 4/2010 |
| WO | 2010/108838 | A1 | 9/2010 |
| WO | 2012/111034 | A1 | 8/2012 |
| WO | 2013/159198 | A1 | 10/2013 |
| WO | 2015/008528 | A1 | 1/2015 |

OTHER PUBLICATIONS

"The Most Accurate Smart Blister in the World", "med-ic Smart Label", 2011, Publisher: IMC Information Mediary Corp.
Advisory Action (PTOL-303) received for U.S. Appl. No. 14/879,874, dated Aug. 1, 2018, 3 pages.
Advisory Action (PTOL-303) received for U.S. Appl. No. 15/170,121, dated Aug. 3, 2018, 4 pages.
Applicant Initiated Interview Summary (PTOL-413) received for U.S. Appl. No. 14/879,874, dated Mar. 13, 2019, 3 pages.
Applicant Initiated Interview Summary received for U.S. Appl. No. 14/879,874, dated Jul. 5, 2018, 3 pages.
Applicant Initiated Interview Summary received for U.S. Appl. No. 15/170,121, dated Jul. 5, 2018, 3 pages.
Ariel Bogle, "Soon Your Medicine Bottle Could Remind You to Take Your Pills", "Future Tense—The Citizen's Guide to the Future", Aug. 19, 2013, Publisher: ASU I New America I Slate.
Authorized Officer: Melissa Koval, "International Preliminary Report on Patentability" dated Sep. 1, 2017 in PCT Application No. PCT/US16/55516.
Examiner initiated interview summary (PTOL-413B) received for U.S. Appl. No. 14/879,874, dated Jun. 3, 2019, 2 pages.
Examiner initiated interview summary (PTOL-413B) received for U.S. Appl. No. 15/170,121, dated Aug. 3, 2018, 1 pages.
"Non-Final Rejection" issued in U.S. Appl. No. 15/170,121, dated Nov. 20, 2017.
Final Office Action received for U.S. Appl. No. 14/879,874, dated May 14, 2018, 35 pages.
Final Office Action received for U.S. Appl. No. 15/170,121, dated May 29, 2018, 20 pages.
Non-Final Office Action received for U.S. Appl. No. 14/879,874, dated Oct. 10, 2017, 29 pages.
Non-Final Rejection received for U.S. Appl. No. 14/879,874, dated Feb. 26, 2019, 40 pages.
Non-Final Rejection received for U.S. Appl. No. 15/170,121, dated Mar. 7, 2019, 21 pages.
Notice of Allowance and Fees Due (PTOL-85) received for U.S. Appl. No. 14/879,874, dated Jun. 3, 2019, 19 pages.
Notice of Allowance and Fees Due (PTOL-85) received for U.S. Appl. No. 15/170,121, dated Apr. 30, 2019, 14 pages.
Notice of Allowance received for U.S. Appl. No. 15/223,779, dated Apr. 19, 2018, 8 pages.
Officer: Jean Sommer, "International Search Report", PCT/US2016/055516, Completed Jan. 5, 2017.
Officer: Ioannis Kousouretas, "International Search Report", PCT/US2016/055535, Completed Jan. 16, 2017.
Sarkar et al., "Efficient 2D and 3D electrical impedance tomography using dual reciprocity boundary element techniques", "Engineering Analysis with Boundary Elements", Jul. 1998, Publisher: Research Gate.
Silva et al., "Influence of current injection pattern and electric potential measurement strategies in electrical impedance tomography", Mar. 2, 2016, Publisher: Elsevier Ltd., Publication: "Control Engineering Practice", http://dx.doi.org/10.1016/j.conengprac.2016.03.003, Country: BR.
Todd O'Connor, "mTouch (TM) Projected Capacitive Touch Screen Sensing Theory of Operation", ISBN:978-1-60932-466-7, Publisher Microchip Technology Inc., vol. DS93064A, pp. 1-16, Jan. 5, 2010, US.
Yang et al., "A Health-loT Platform Based on the Integration of Intelligent Packaging, Unobtrusive Bio-Sensor and Intelligent Medicine Box", "Transactions on Industrial Informatics", 2014, pp. 1-13, Publisher: IEEE; DOI: 10.1109/TII.2014.2307795.

(56) References Cited

OTHER PUBLICATIONS

Yongjia (Allen) Yao, "Wearable Sensor Scanner using Electrical Impedance Tomography", Sep. 26, 2012, Publisher: University of Bath, Country: UK.

* cited by examiner

APPARATUS FOR MONITORING THE CONTENT OF A CONTAINER AND METHOD THEREFOR

CROSS REFERENCE TO RELATED APPLICATIONS

This case is a continuation of co-pending U.S. patent application Ser. No. 15/170,121, filed Jun. 1, 2016, which claims priority of U.S. Provisional Patent Application Ser. No. 62/320,234, filed Apr. 8, 2016, and which is a continuation-in-part of U.S. patent application Ser. No. 14/879,874, filed Oct. 9, 2015, which claims priority of U.S. Provisional Patent Application Ser. No. 62/062,291, filed Oct. 10, 2014 and U.S. Provisional Patent Application Ser. No. 62/137,988, filed Mar. 25, 2015, each of which is incorporated by reference. If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to packaging in general, and, more particularly, to smart packaging.

BACKGROUND OF THE INVENTION

The term "packaging" refers to the collection of different components that surround a product from the time of its production until its use. It typically serves many purposes, often simultaneously, such as providing protection from physical damage during shipping and handling, theft deterrence, providing protection from electrical damage due to electrostatic discharge, etc., inhibiting product degradation, and the like.

Medical packaging, such as packaging for pharmaceutical products, etc., has additional, typically more stringent requirements. For example, in addition to the above, medical packaging must also prevent tampering, inhibit contamination, hinder microbial growth, and ensure product safety through the intended shelf life for the medicine. Still further, medicine must also typically be packaged in such a way that the packaging inhibits accidental ingestion, such as by a child, which can lead to injury or death.

Recent technology development has enabled the addition of a level of intelligence to many packages. So-called "smart" packages (a.k.a., "connected packaging") include electronics that can be used to detect product removal, monitor the state of the package, and even send messages about the state of the product. Smart packaging is particularly attractive for medical packaging, where it can improve patient compliance by alerting a healthcare professional or care giver if a dose has been missed or taken too soon. In some cases, a smart package can even issue alerts to indicate product expiration, exposure to excess heat, unanticipated access to the medicine (e.g., opening by a child, etc.), and the like.

Medication non-compliance is a costly problem in many ways, from driving up health care costs, to financial losses to the pharmaceutical industry, to serious negative human impacts. According to Kripalani, et al., in a study entitled "Interventions to enhance medication adherence in chronic medical conditions: a systematic review," Archives of Internal Medicine, Vol. 167, pp. 540-550 (2007), between 20 and 50 percent of patients do not adhere to their medication regimens and, therefore, do not receive the medicine they have been prescribed. As a result of such non-compliance, it is estimated that approximately 125,000 people die each year. In addition to the human cost, non-compliance has an economic cost, leading to an estimated $564 billion annually, or 59% of the $956 billion in total global pharmaceutical revenue in 2011.

By including embedded monitoring systems, connected packaging can help combat adherence challenges, thereby improving drug efficacy and outcomes, among other advantages. In addition, improved patient compliance enables a caregiver to better measure the effectiveness of the prescribed medication, thereby enabling them to improve outcomes by altering or augmenting treatment. This also can enable the caregiver better target drug delivery means (e.g., tablets, liquids, inhalers, patches, etc.) and optimize or personalize the dosage prescribed.

In addition to enabling improved treatment of the individual patient, connected packaging enables better and more confident collection and analysis of patient data, which can benefit the drug industry and patients at-large by extending drug intellectual property, opening new markets, creating or improving drug-delivery mechanisms, shortening clinical trials due to collect a greater amount of more-relevant, higher-quality data, reducing the burdens on clinical trial patients (e.g., reduced travel, etc.), and providing real-time feedback on how a clinical trial is progressing. Still further, connected packaging promises improved medical diagnostics, which can improve opportunities for discovery of new indications for existing drugs, new candidates for drug treatment, and the like.

Connected drug packaging, therefore, can have positive implications for the entirety of a drug's life cycle from research through production to consumption.

Many medications come in a blister pack, particularly outside of the United States. A conventional medical blister-pack typically includes a formable layer, containing a plurality of tablet reservoirs, and a thin layer, referred to a lidding seal, that is attached to the formable layer to seal each tablet in its reservoir. To dispense a tablet from a blister pack, its reservoir is pushed inward, which forces the tablet through the lidding seal, thereby creating a permanent deformation of the lidding seal layer each and every time a tablet is removed. The most common blister-pack-based smart packaging approach relies on patterned electrical traces formed on the lidding seal, where a separate trace is disposed over each tablet reservoir. Electronic circuitry monitors the resistance of each trace and detects an infinite resistance for each trace that is broken.

Unfortunately, such conductive-trace-based approaches are limited to blister-pack-based packages while many medicines are often packaged in other ways. In fact, the most common pharmaceutical package is still the simple medicine bottle, which is used for pharmaceuticals in forms that range from liquids to loose tablets. Such packaging requires more complicated approaches for adding intelligence. For example, one prior-art approach relies on optical monitoring of tablets within a medicine bottle. The need to include active optical sources, as well as detectors, significantly increases packaging costs, however. Further, such devices are notoriously power hungry, which shortens the life of a battery used to power them.

A far simpler prior-art bottle-based approach employs a load-cell in a unit that holds the bottle. The load-cell provides an output signal indicative of the weight of the medicine remaining within the bottle, thereby enabling detection of a change in that amount. While simple and straight-forward, such an approach is limited to detecting only quantity of medicine and relies on the patient to return the bottle to the unit. Further, its output can be compromised by any inadvertent material that accidently winds up in contact with the bottle or the unit.

A smart-packaging approach that is capable, reliable, and applicable to product packaging other than blister packs would be a welcome advance for the pharmaceutical industry.

SUMMARY OF THE INVENTION

The present invention enables tracking of a product, such as drugs, medication, foodstuffs, consumer electronics, batteries, etc., from production to consumption through connected packaging. Embodiments of the present invention are operative for wirelessly reporting medication adherence, environmental exposure (e.g., temperature), tampering, and theft. Embodiments of the present invention are particularly well suited for use with pharmaceutical products packaged in medicine bottles.

An embodiment of the present invention is a monitoring system that comprises a liner and associated electronics operative for imaging the content of a container using electrical capacitance tomography or acoustic imaging, and using a series of images of the content to monitor the state of the content over time. The liner comprises a plurality of electrodes that are arranged and interconnected so to image the three-dimensional volume of the container at high resolution. In an illustrative embodiment, the liner dimensioned and arranged such that it can be inserted into the interior of the container to be monitored. The liner is flexible, thereby enabling it to substantially conform to the interior surface of the container without consuming a significant portion of its interior volume.

In some embodiments, the liner includes a central pedestal that comprises a plurality of electrodes. In some such embodiments, the electronics are located in or on the pedestal.

In some embodiments, the electrodes include a common ground. In some embodiments, the common ground is a ground plane. In some embodiments, the ground plane is dimensioned and arranged to act as a shield that mitigates electrical coupling between the electrodes and influences from outside the connected package (e.g., a hand holding the package, etc.).

In some embodiments, the liner is designed to accept a container such that, when so arranged, the electrodes of the liner are located outside the container.

In some embodiments, the liner is dimensioned and arranged such that it images only a portion of the volume of the container and leaves a portion of the container exposed so as to make printing/labeling on the container visible.

In some embodiments, the liner and label are integrated by forming the electrodes and traces on the back of the label itself (e.g., by printing them using conductive ink, forming them via thin-film processing, etc.), thereby forming a label that is a liner that accepts a medicine bottle.

An embodiment of the present invention is an apparatus for monitoring a content of a chamber of a container, the apparatus comprising: a liner that comprises a first plurality of electrodes, the liner being dimensioned and arranged to locate the first plurality of electrodes such that they are electrically coupled with the content; and electronic circuitry that is operative for performing a first measurement of a distribution of a first characteristic of the content via a technique selected from the group consisting of electrical capacitance tomography (ECT) and acoustic imaging, wherein the first characteristic is selected from the group consisting of permittivity and acoustic impedance wherein the first measurement includes: (1) generating a plurality of stimulus signals, each stimulus signal of the plurality thereof being generated between a different pair of electrodes of the first plurality thereof; (2) for each stimulus signal of the plurality thereof, measuring a response signal at each other electrode of the first plurality thereof to define a response-signal set, wherein the plurality of stimulus signals and the plurality of response-signal sets have a one-to-one correspondence; and (3) generating a map of the first characteristic of the content based on the plurality of stimulus signals and the plurality of response-signal sets.

Another embodiment of the present invention is a method for monitoring a content of a chamber of a container, the method comprising: (1) providing a liner that comprises a plurality of electrodes, the liner being configured to locate the plurality of electrodes such that they are electrically coupled with the content; (2) generating a first map of a distribution of a first characteristic of the content at a first time, wherein the first map is generated via a technique selected from the group consisting of electrical capacitance tomography (ECT) and acoustic imaging, wherein the first characteristic is selected from the group consisting of permittivity and acoustic impedance, and wherein the first map is generated by operations comprising; (a) generating a first plurality of stimulus signals, each stimulus signal of the first plurality thereof being generated between a different pair of electrodes of the plurality thereof; and (b) for each stimulus signal of the first plurality thereof, measuring a response signal at each other electrode of the plurality thereof to define a response-signal set of a first plurality thereof, wherein the first plurality of stimulus signals and the first plurality of response-signal sets have a one-to-one correspondence; wherein the first map is based on the first plurality of stimulus signals and the first plurality of response-signal sets; and (3) determining a first quantity of the content within the chamber at the first time based on the first map.

DETAILED DESCRIPTION

This patent application is a continuation-in-part of parent patent application U.S. application Ser. No. 14/879,874, which discloses the application of electrical impedance tomography (EIT) to blister-pack-based packaging.

Blister packs are used globally for unit-dose packaging of pills, capsules, lozenges, etc. They protect medication from environmental factors such as humidity, oxidation, light, contamination, and (to some degree) tampering. In the United States, however, pills, capsules, and the like are often repackaged/dispensed at the pharmacy and delivered to the patient in a medicine bottle or similar container. Unfortunately, EIT imaging techniques cannot usually be used directly to image the content of a medicine bottle because it typically comprises dielectric materials (i.e., electrically nonconductive tablets, liquids, air, etc.).

It is an aspect of the present invention, however, that a variation of the EIT technique, referred to as Electrical Capacitance Tomography (ECT) is well suited for imaging content comprising dielectric material, such as tablets, air, medicinal liquids, gels, and the like, and can be employed to image the content of medicine bottles (as well as other non-pharmaceutical packages) even when that content is dielectric in nature.

Embodiments of the present invention are afforded significant advantages over connected-packaging systems of the prior art because the present invention does not require disruption of conventional pharmaceutical package manufacturing processes, which are well established. Over the years, there has been tremendous capital investment made toward improving and advancing these processes, and they are considered substantially optimized. Connected-packaging solutions that require modification of the current package manufacturing processes would be, therefore, less attractive and likely met with resistance by the pharmaceutical packaging industry.

The present invention is directed, in part, to connected-packaging solutions for pharmaceuticals, with a focus on medicine containers comprising medicine bottles. For the purposes of this Specification, including the appended claims, the term "medicine bottle" is defined to mean any and all variety of vessels comprising a chamber suitable for containing medication. It should be noted, however, that embodiments of the present invention can be directed to myriad applications, including non-pharmaceutical-packaging applications.

Figure 1B:
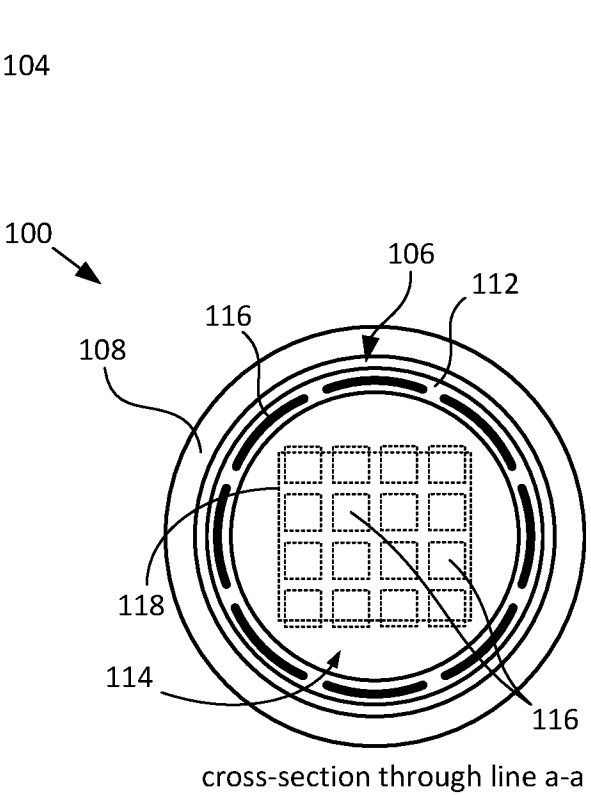
FIGS. 1A-B depict schematic drawings of cross-sectional side and top views, respectively, of a "smart" medicine bottle in accordance with an illustrative embodiment of the present invention.
Figure 1A:
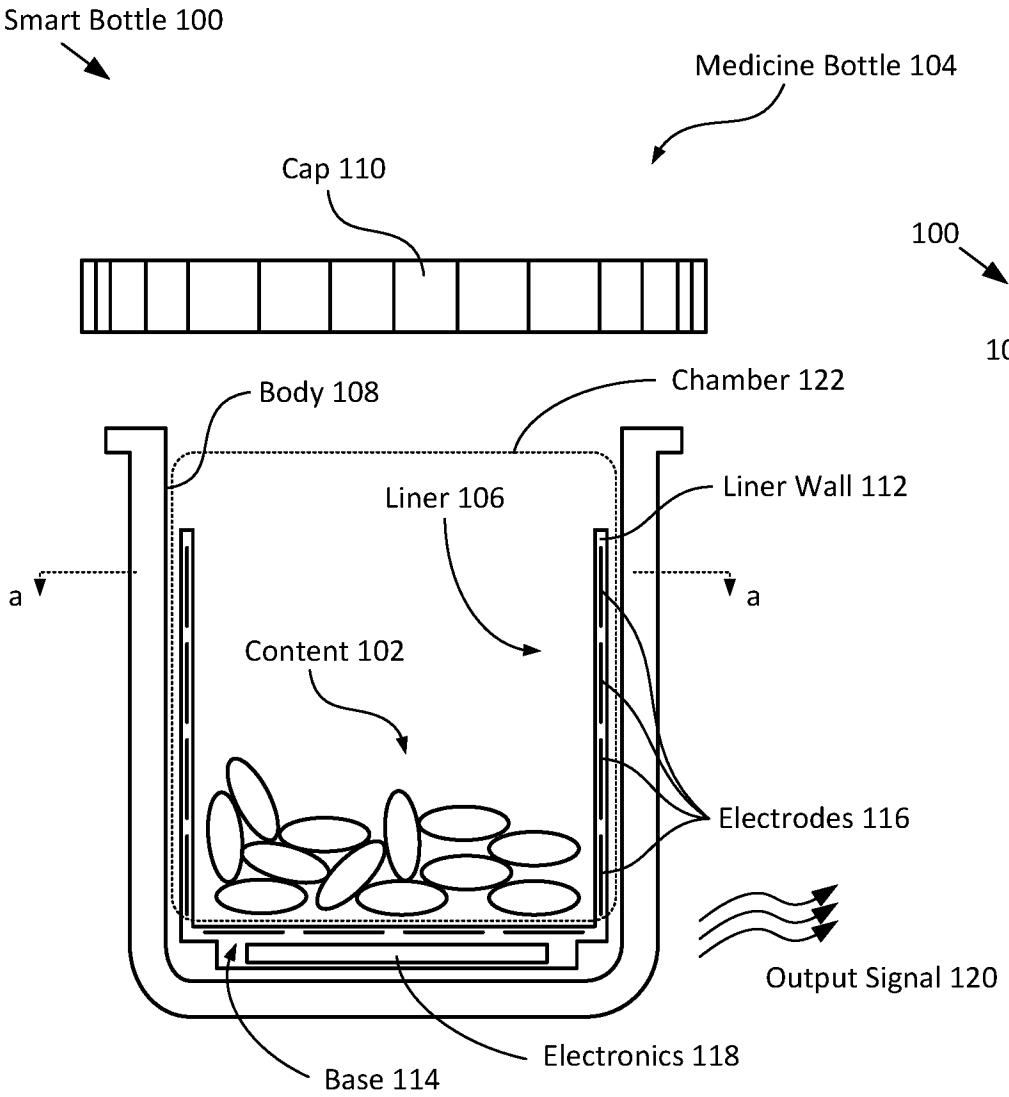

FIGS. 1A-B depict schematic drawings of cross-sectional side and top views, respectively, of a "smart" medicine bottle in accordance with an illustrative embodiment of the present invention. FIG. 1B depicts a cross-sectional view through line a-a as indicated in FIG. 1A. Smart bottle 100 is a connected-packaging container for holding content 102 and protecting it from environmental damage, tampering, and the like. Smart bottle 100 includes medicine bottle 104 and liner 106.

Content 102 is a plurality of tablets comprising compressed-powder that includes medicine. For the purposes of this Specification, including the appended claims, the term "content" is used to represent any form pharmaceutical product including, without limitation, tablets, pills, capsules, gel-caps, powder, fluids, gels, and the like. In the depicted example, the content of the chamber of medicine bottle 104 includes tablets and air, both of which comprise dielectric materials. One skilled in the art will recognize, after reading this Specification, that pills, for example, are normally made of substantially dry power, which is a material suitable for ECT imaging as disclosed herein. In similar fashion, gel capsules comprise fluids contained within gelatin-based shells that are typically made from dielectric materials. The fluids are also often dielectric, but can still be imaged by ECT even if they have finite conductivity. It should be noted that when medicine bottle 104 includes contents that are a conductive fluid, EIT imaging techniques, such as those described in the parent application (i.e., U.S. application Ser. No. 14/879,874) and its incorporated references, can be used to image the fluid. In such embodiments, electrodes 116 would be exposed so that they can be in electrical contact with the fluid.

Medicine bottle 104 is a conventional medical bottle comprising body 108 and cap 110, each of which is made of a pharmaceutical-produced-compatible polymer material, such as medical-grade plastic. Body 108 is formed such that it defines chamber 122, which is an interior volume suitable for holding content 102. In some embodiments, at least one of body 108 and cap 110 comprises a different material, such as glass, metal, composite materials, and the like. It should be noted that medicine bottle 104 is merely one example of myriad types of common pharmaceutical containers suitable for use with the present invention.

Liner 106 is an electrically active lining that is dimensioned and arranged to fit in medicine bottle 104. Liner 106 includes liner wall 112, base 114, electrodes 116-1 through 116-N, and electronics 118. Liner 106 is typically formed using conventional flexible-electronics manufacturing methods.

Liner wall 112 and base 114 are formed from a solid sheet of flexible material suitable for use with pharmaceutical compounds. Materials suitable for liner wall 112 and base 114 include, without limitation, thermoplastic polymers, such as Polypropylene, Polyethylene terephthalate (PET), etc., and the like. In some embodiments, liner wall 112 and base 114 are formed separately and joined afterward.

Each of electrodes 116-1 through 116-N (electrodes 116-*i*, where $1 \leq j \leq N$ and N is any practical number—referred to, collectively, as electrodes 116) is a thin-film electrode embedded within liner 106. Electrodes 116 are distributed along liner wall 112 and across base 114. Materials suitable for use in electrodes 116 include, without limitation, metals, conductive inks, conductive polymers, conductive paints, etc. Electrodes 116 are arranged within liner wall 112 such that they are electrically coupled with the content of chamber 122. For the purposes of this Specification, including the appended claims, the term "electrically coupled" is defined to mean that an electrical signal generated or received by one or more electrodes is based on an interaction of the electrical signal with the content of the chamber. In the depicted example, electrodes 116 are distributed about the circumference and along the height of chamber 122 after liner 106 is inserted into the bottle. As a result, electrodes 116 are operative for imaging radial cross-sections of the interior of the medicine bottle, where the cross-sections collectively image the height of the medicine bottle interior.

In some embodiments, electrodes 116 and/or electronics 118 are fabricated on at least one of the inner and outer surfaces of liner 106. When disposed on the inner wall of the liner, however, the electrode (and electronics) material must be compatible with the medication and sanitization processes (where necessary). When disposed on the outer wall surface, the electrode (and electronics) material must be durable so as to withstand damage due to wear and corrosion.

In some embodiments, electronic components (e.g., chips, resistors, capacitors, etc.) are mounted on a surface of the liner, in analogous fashion to mounting them on a printed circuit board. As a result, electronics provisions can be integrated onto/into the liner in locations that do not already incorporate electrodes/interconnects.

In some embodiments, base 114 does not include electrodes 116; however, the inclusion of electrodes in the bottom of liner 106 provides for additional spatial imaging that can add detail when content 102 includes only a small amount of medication, such as when the dispensed medication is nearly gone or when there is only a small amount dispensed. These electrodes can also be used to determine the size of an individual pill, since even a single pill would rest on the bottom of the bottle.

It should be noted that the resolution of the imaging of the interior volume of medicine bottle 104 generally depends on the number, size, density and positioning of electrodes 116 for a given content and bottle size/shape. These parameters can be optimized to sense/count the number of individual tablets in chamber 122 or simply monitor the overall volume occupied by content 102 inside the chamber. In some embodiments, the number, size, density and positioning of electrodes 116 is based on a particular application objective. For example, if it is only necessary to determine when a refill is approaching or when the medication is exhausted, electrodes are only necessary in the bottom one-third portion medicine bottle 104. In such cases, the height of liner 106 might be only one-third of the height of the interior volume of the bottle, or electrodes 116 might only populate the bottom one-third of a liner wall that extends along the full height of the bottle interior. In embodiments wherein it is desirable to be able to determine the size of an individual pill, preferably, the electrodes located on the bottom of liner 106 are small and numerous such that they form a dense electrode arrangement. In embodiments wherein it is desirable to image and/or count the number of pills coming out of the bottle, preferably, the electrodes near the top/lip of the liner 106 are small and numerous such that they form a dense electrode arrangement. One skilled in the art will recognize, after reading this Specification, there myriad permutations of liner configuration are within the scope of the present invention.

In some embodiments, liner 106 is reusable, which, in some cases, requires that liner wall 112 be cleanable.

It should be noted that, in the depicted example, the interior wall of body 108 and liner 106 are separated by a nominal gap for drawing clarity. Preferably, however, liner 106 fits snugly against the interior wall of the body (i.e., there is minimal or no gap between them). Further, liners that are dimensioned and arranged to be inserted into a medicine bottle, such as liner 106, are preferably used with medicine bottles having an opening and neck region that is at least as wide as its main body region (such as medicine bottle 104) so that the liner can easily be inserted into the bottle.

It should be further noted that interconnect traces to the electrodes are also typically included in liner 106 (not shown for drawing simplicity). These interconnects are normally fabricated from the same conductive material layer as the electrodes, or fashioned from multiple conductive material levels through the thickness of liner wall 112. The manner in which the interconnect traces and electrodes are fabricated is based upon real estate restrictions imposed by the electrode layout. For the purposes of this Specification, the term "electrodes 116" is intended to encompass the requisite electrical interconnects between electrodes 116 and electronics 118.

Electronics 118 includes electronic circuitry and/or electronic modules for enabling ECT imaging, wireless communication to and from smart bottle 100, a processor for performing data and/or image processing necessary for generating a permittivity distribution within medicine bottle 104 and determining the amount of content 102, and a memory cell for storing data, such as the number of tablets, patient history, chronology of medication events, and the like. In some embodiments, at least some of data/image processing and data storage is done at a system external to electronics 118, such as a cellphone or computer system accessible by a caregiver, the patient, a pharmacy, a medical practitioner, and the like. In the depicted example, electronics 118 are embedded in the bottom portion of medicine bottle 104; however, in some embodiments, electronics 118 are located in another suitable place on liner 106. Typically, electronics 118 also includes modules for signal processing/computation, memory and power (e.g., inductive, battery, ultrasonic, etc.). In some embodiments, an antenna is included in electronics 118 to enable wireless connectivity. In some embodiments, an antenna is formed in liner wall 112 during the formation of electrodes 116. In some embodiments, electronics 118 includes local memory, in which this data is stored.

In some embodiments, electronics 118 includes additional modules for sensing motion and/or touch, removal of cap 110, bottle orientation, and the like. For example, in some embodiments, motion- and/or touch sensing capability is used to extend battery life by energizing a wake-up circuit that enables ECT imaging only when the medicine bottle has been moved. Further, in some embodiments, predictive algorithms are employed with motion sensing to detect when the medicine bottle is opened and/or the orientation of the medicine bottle. Such additional information facilitates and/or augments the use of ECT to monitor medication-dispensing events.

It is preferable, although not required, that smart bottle 100 is untethered so that its use does not inconvenience the patient or caregiver. As a result, in the depicted example, the requisite electrical sensing and communication provisions are wireless and the medicine bottle is "self-reporting". The choice of wireless protocol is dominated primarily by power and cost requirements. Broadband/cellular communication is typically most preferable since it does not require a local/short-range gateway to connect to the network; however, it is also the most taxing in terms of power and cost. In some embodiments, short-range wireless protocols (e.g., Blue Tooth Low-Power, Near Field Communication, Inductive Coupling, etc.) are used to communicate with a local gateway (e.g., patient's or caregiver's cell phone, custom gateway, etc.); however, such embodiments require that smart bottle 100 be located near the gateway.

In addition, low-power-consumption electronics are preferable to mitigate the need for on-board power. A power source in, or on, liner 106 is desirable for self-reporting. Minimizing power consumption also enables smaller batteries (both planar and height profiles), including perhaps thin film batteries. Batteries that can be recharged inductively would be convenient/advantageous, particularly if extended use or reuse of the liner is intended.

One skilled in the art will recognize, after reading this Specification, that, because electrodes 116 are located within medicine bottle 104, body 108 can be made of dielectric materials, non-dielectric materials (i.e., electrically conducting materials, such as metals, etc.), or combinations thereof. In some embodiments, however, it is desirable to locate electrodes 116 in a receptacle that accepts medicine bottle 104, such that the electrodes are located outside body 108, as discussed below and with respect to FIGS. 5-7. In such embodiments, body 108 must be made of dielectric material in order to enable ECT imaging of content of medicine bottle 104. One skilled in the art will recognize that, in embodiments wherein body 108 is electrically conductive, data transmission to/from electrodes 116 is typically only possible when the bottle is open.

Figure 2:
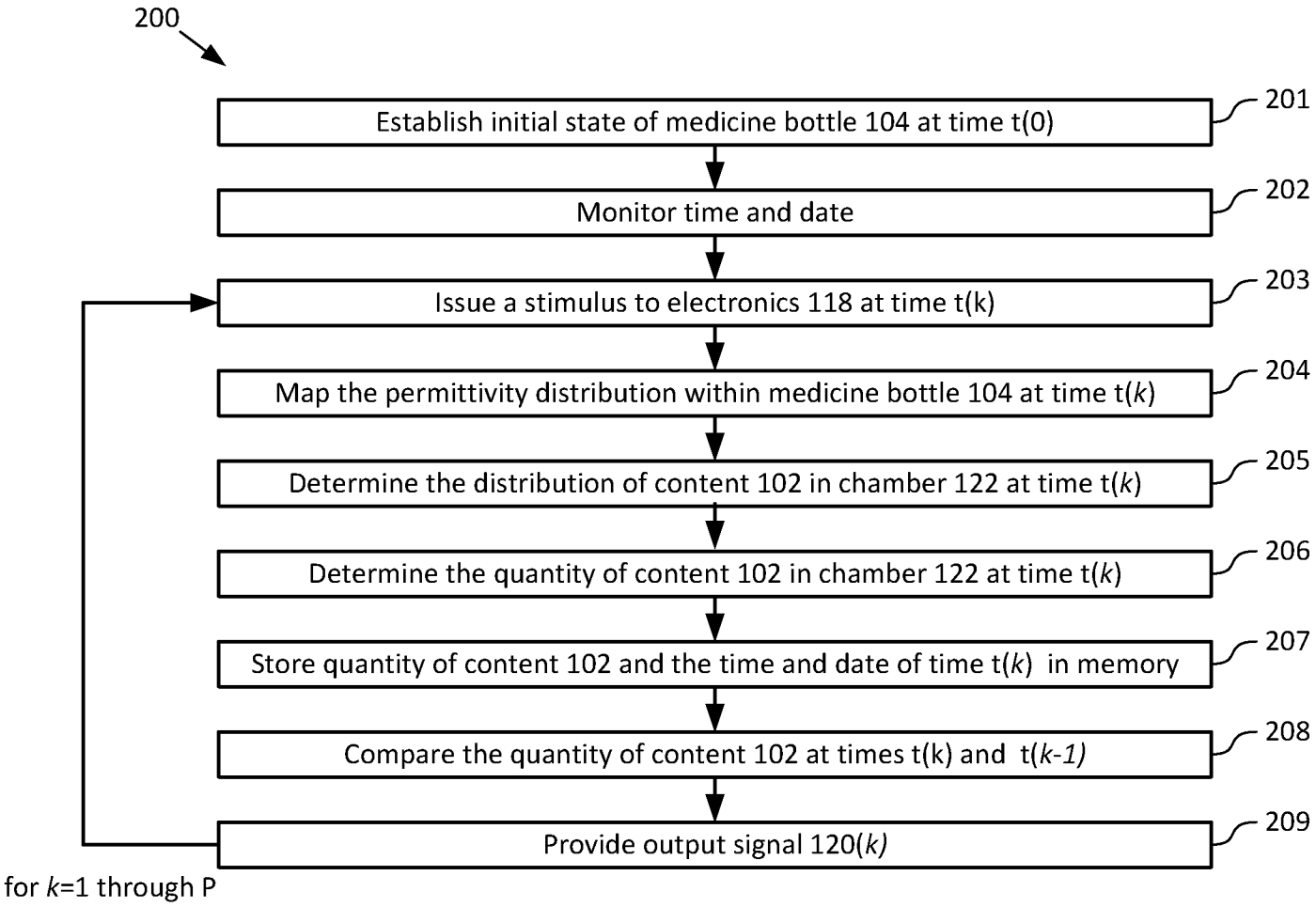
FIG. 2 depicts operations of a method for monitoring the content of a container via ECT in accordance with the illustrative embodiment of the present invention.

FIG. 2 depicts operations of a method for monitoring the content of a container via ECT in accordance with the illustrative embodiment of the present invention. Method 200 monitors the content of medicine bottle 104 by creating a map of the relative permittivity distribution throughout its interior volume and tracking any changes to that distribution.

It should be noted that ECT is fundamentally different from capacitive sensing between electrode pairs, such as is described in U.S. Pat. No. 8,754,769. In capacitive sensing, a stimulus (e.g., current) is applied across a pair of electrodes, and a response (e.g., voltage) is measured across the same pair of electrodes. This stimulus/response measurement indicates an aggregate (or effective) permittivity between the two electrodes.

ECT, in contrast, determines the distribution of the content of a vessel by measuring the related permittivity distribution through the volume of the vessel. ECT is most successful when applied to materials of low electrical conductivity. The requisite capacitance measurements are achieved by using a plurality of conductive electrodes that surround the volume to be imaged, as depicted in FIGS. 1A-B. In one implementation, a cross section to be imaged is surrounded by one or more circumferential sets of electrodes and the electrical capacitances between all combinations of the electrodes within each set are measured. This information is then used to construct an image of the content of the cross section of the vessel enclosed by the electrodes, based on variations in the permittivity of the material inside the vessel.

Method 200 begins with optional operation 201, wherein an initial state of medicine bottle 104 is established. The initial state is established at time t(0), which is typically the time at which the medication is dispensed. In some embodiments, the initial state is established by simply storing a tablet count in the memory module of electronics 118. In some embodiments, the initial state is established via an ECT procedure, as discussed below and with respect to operations 203 through 205.

At operation 202, electronics 118 monitors date and time.

At operation 203, for k=1 through P, a stimulus is issued to electronics 118 at time t(k) to initiate an interrogation of the volume of medicine bottle 104. In the depicted example, the stimulus is an alarm generated by electronics 118 at a time that is based on the dosage schedule for content 102. In some embodiments, the stimulus is generated at a time that is delayed slightly from the time at which a scheduled dose is due. In some embodiments, the stimulus is generated by another factor, such as motion of medicine bottle 104, detection of the removal of cap 110, receipt of a signal from an external source, such as a cell phone, monitoring system accessible to a caregiver, medical practitioner, etc., and the like.

It should be noted that the value of P is typically based on the medication regimen associated with content 102. For example, in the depicted example, P is equal to the number of tablets initially contained in medicine bottle 104. In some embodiments, P is equal to the number of days over which the medication is supposed to be taken. In some embodiments, P is equal to another factor associated with the medicine regimen.

At operation 204, a map of the permittivity distribution within the volume of medicine bottle 104 is generated at time t(k). The map of permittivity is developed by applying an electronic stimulus(in the depicted example, AC current) between each pair of electrodes in the set of electrodes 116 and measuring an electrical response (in the depicted example, AC voltage) at each other electrode in the set. For example, for each of l=1 through N and j=1 through N, where i and j are not equal, an AC current is applied between electrodes 116-*i* and 116-*j* and an AC voltage is measured at each of the other electrodes in the set. In other words, the stimulus/response is measured for all combinations of electrode pairs in the set of electrodes 116. In some embodiments, the stimulus is an AC voltage and the measured response is an AC current. In yet other embodiments, a stimulus other than voltage or current is applied between electrodes 116-*i* and 116-*j* and a response other than current or voltage is measured at each of the other electrodes. One skilled in the art will recognize, after reading this Specification, that myriad strategies for stimulating and measuring electrical response at electrodes 116 are within the scope of the present invention. Examples of stimulation/measurement strategies applicable for EIT and ECT modelling in accordance with the present invention are described by Silva, et al., in "Influence of current injection pattern and electric potential measurement strategies in electrical impedance tomography," Control Engineering Practice (2016), as well as by Y. Yao, in "Wearable Sensor Scanner using Electrical Impedance Tomography," PhD Thesis, University of Bath (2012), each of which is incorporated herein by reference.

In some embodiments, electrodes 116 include a common ground from which the potential at each electrode measured is referenced. In some embodiments, this common ground is a ground plane. In some embodiments, the ground plane also acts as a shield to mitigate external influence on the measured electrical response at each electrode. For example, one skilled in the art will recognize, after reading this Specification, that a hand grasping a medicine bottle will perturb the measurements at the electrodes due to coupled capacitance. A ground plane that acts as a shield between the electrodes and the hand would mitigate such effects, however. In some embodiments, one or more of electrodes 116 comprise configurations that incorporate shielding lines as described in U.S. Provisional Patent Application Ser. No. 62/320,234, which is incorporated herein by reference.

At operation 205, the distribution of content 102 within chamber 122 is determined based upon the permittivity distribution map at t(k). In the depicted example, the distribution of the content indicates the number and types of tablets contained in medicine bottle 104.

It should be noted that the dielectric constant of an individual tablet is based on its chemical makeup. As a result, the type of medication, dosage level, pill shape, and the like, affect the capacitance of each tablet. It is an aspect of the present invention, therefore, that the use of ECT can provide an indication of the types of tablets within chamber 122, as well as the number of each type. As a result, the present invention enables, for example, determination of whether the bottle contains the correct medication or if an incorrect tablet or fluid has been used. It even enables detection that one or more improper tablets have been accidently included along with the correct tablets. This is in marked contrast to capacitive sensing, which can only measure an aggregate permittivity between the two electrodes and affords embodiments of the present invention with significant advantages over prior-art capacitive-sensing methods.

At operation 206, the quantity of content 102 (i.e., the number and type of tablets) is determined from their distribution within chamber 122. It should be noted that electromagnetic and mathematical modeling techniques applicable to ECT imaging are well established and widely used in many industrial applications, for example, measuring the flow of fluids inside a pipe, concentration of one fluid in another or distribution of a solid in a fluid.

At operation 207, the quantity of content 124 at time t(k), as well as the time and date of time t(k) are stored in memory. In some embodiments, this data is transmitted to an external memory system, such as a cellphone or monitoring system accessible by a caregiver, the patient, a pharmacy, a medical practitioner, and the like.

At operation 208, electronics 118 compares the quantity of content 102 (i.e., the number of tablets) at time t(k) to the quantity of content 102 determined at time t(k−1).

At operation 209, electronics 118 generates output signal 120(*k*), which is indicative of the state of smart bottle 100, typically denoting the correct amount of content 102 has been dispensed as scheduled, how much content was dispensed, the date and time at which the content was dispensed, and the like. In some embodiments, output signal 120(*k*) includes additional information, such as any anomalies in the environmental conditions to which smart bottle 100 was subjected, etc., a warning that the medication is nearly or entirely exhausted, a prompt for refilling the prescription for the medication, an identification code, the geographical location of smart bottle 100, and the like.

In some embodiments, electronics 118 transmits an alarm in response to an unexpected stimuli, such as exposure to a temperature or humidity extreme, excessive shock, unscheduled access to medicine bottle 104, which might indicate unauthorized access such as tampering, ingestion by a child, etc.

It should also be noted that, although the illustrative embodiment described above is directed to ECT imaging techniques, other imaging techniques, such as acoustic imaging, are also within the scope of the present invention. In acoustic-imaging-based embodiments, electrodes 116 (excluding interconnects) are replaced with a composite layer stack of thin-film conductor/piezoelectric/conductor materials to enable generation of acoustic waves and their detection after reflection from content 102, where the reflection of the acoustic waves is based on the distribution of acoustic impedance within the content. Suitable piezoelectric materials would include, without limitation, polyvinylidene difluoride (PVDF), lead-zirconate titanate (PZT), zinc oxide (ZnO) and the like. PVDF is particularly attractive due to the fact that it is a strongly non-reactive and pure thermoplastic fluoropolymer derived from polymerization of vinylidene difluoride.

Figure 3:
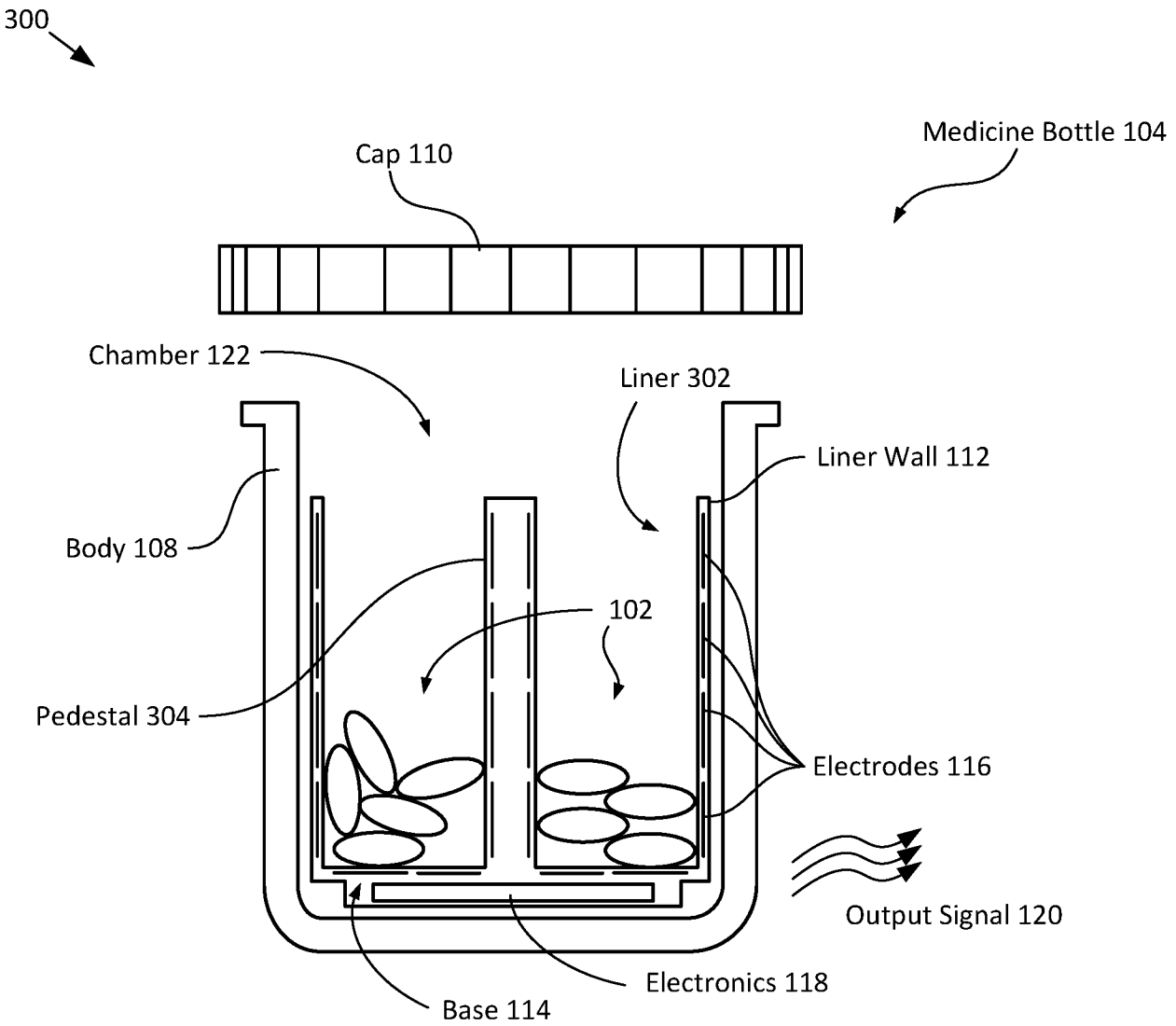
FIG. 3 depicts a schematic drawing of a cross-sectional side view of a smart bottle in accordance with a first alternative embodiment of the present invention.

FIG. 3 depicts a schematic drawing of a cross-sectional side view of a smart bottle in accordance with a first alternative embodiment of the present invention. Smart bottle 300 comprises medicine bottle 104 and liner 302. Smart bottle 300 is well suited for applications that require high-resolution imaging, such as when content 102 includes a large number of small tablets. System 300 is analogous to system 200; however, liner 302 incorporates central pedestal 304 to enable a greater number of electrodes and, therefore, improved image resolution.

Liner 302 is analogous to liner 106, as described above; however, liner 302 also includes pedestal 304, which enable the inclusion of more electrodes 116 and, therefore, improved image resolution.

It should be noted that the area of liner wall 112 (and, therefore, the number of electrodes 116) can be increased in myriad ways, such as by additional internally protruding features having any of a multiplicity of shapes, which are distributed strategically in the liner. In some embodiments, sub-volumes are created within the overall volume of the liner, thereby increasing the area of liner wall 112 and reducing imaging volume size. In some embodiments, the sub-volumes are designed to trap an individual tablet in order to measure its size independently. In such embodiments, it is possible that dead space can result. In some embodiments, electronics 118 are located within one of these sub-volumes, which represent dead-space regions.

Figure 4:
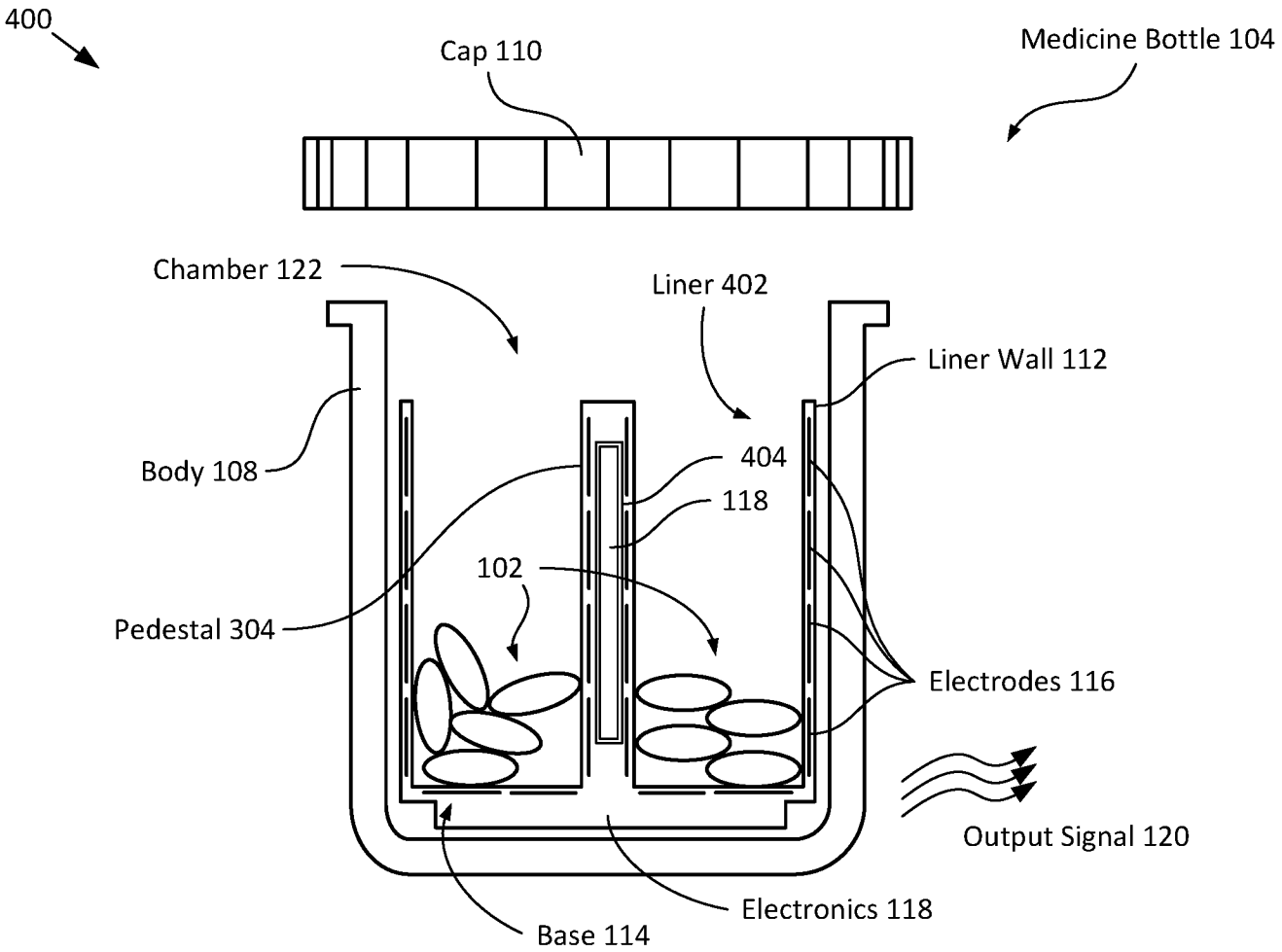
FIG. 4 depicts a schematic drawing of a cross-sectional view of an ECT medicine-imaging system in accordance with a second alternative embodiment of the present invention.

FIG. 4 depicts a schematic drawing of a cross-sectional view of an ECT medicine-imaging system in accordance with a second alternative embodiment of the present invention. Smart bottle 400 is analogous to smart bottle 300; however, in smart bottle 400, liner 402 includes dead-space region 404 within pedestal 304, in which is located electronics 118.

Figure 5B:
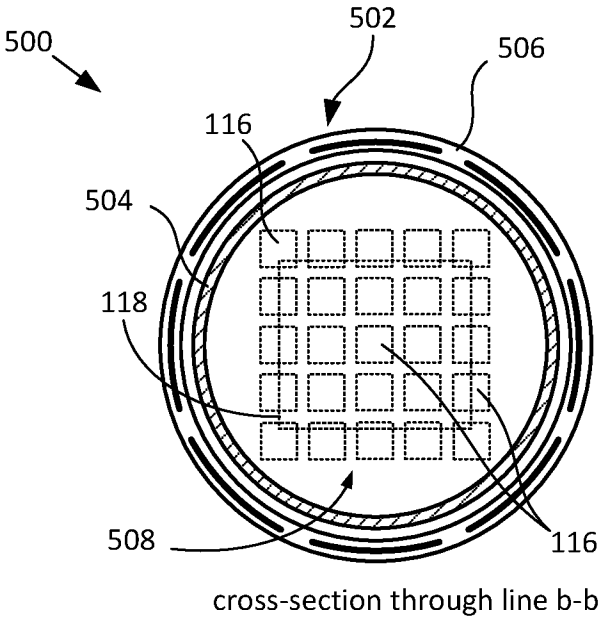
FIGS. 5A-B depict schematic drawings of cross-sectional side and top views, respectively, of a "smart" medicine bottle in accordance with a third alternative embodiment of the present invention.
Figure 5A:
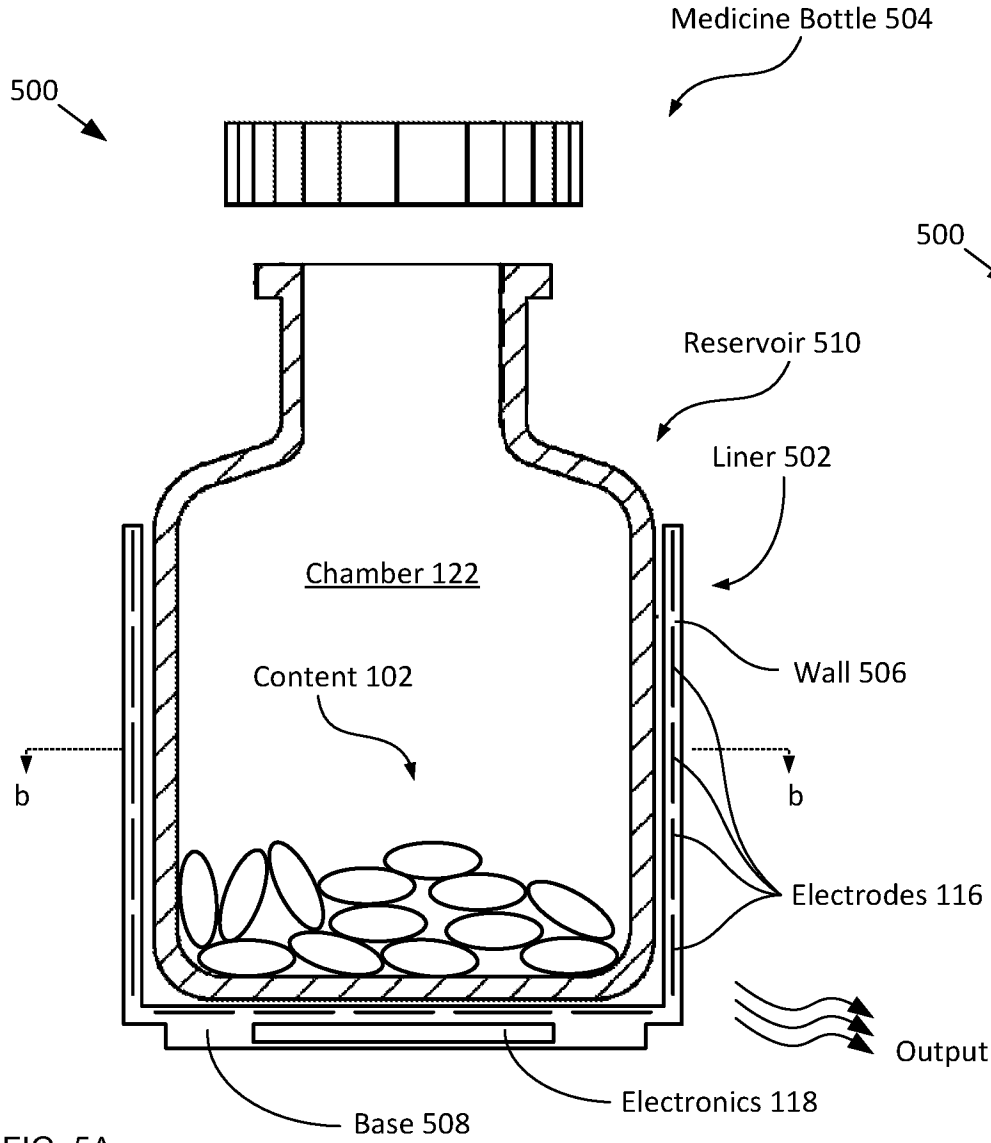

FIGS. 5A-B depict schematic drawings of cross-sectional side and top views, respectively, of a "smart" medicine bottle in accordance with a third alternative embodiment of the present invention. FIG. 5B depicts a cross-sectional view through line b-b as indicated in FIG. 5A. Smart bottle 500 comprises liner 502 and medicine bottle 504. Smart bottle 500 is analogous to system 100; however, in system 500, electrodes 116 are located outside medicine bottle 504 when the bottle and liner are operatively coupled.

Medicine bottle 504 is analogous to medicine bottle 104 described above and with respect to FIGS. 1A-B; however, medicine bottle 504 has a neck region that is narrower than the remainder of its body.

Liner 502 is analogous to liner 106 described above; however, liner 502 is dimensioned and arranged to operate as a receptacle for locating medicine bottle 504 such that chamber 122 is surrounded by electrodes 116. Liner 502 includes wall 506, base 508, electrodes 116, and electronics 118.

Typically, wall 506 and base 508 comprise a substantially rigid dielectric material, such as medical grade plastic, glass, and the like. Wall 506 and base 508 collectively define reservoir 510, which is open at its upper end to enable it to receive medicine bottle 504. In some embodiments, at least wall 506 comprises a flexible dielectric material such that liner 502 can substantially conform to the outer surface of body 108 (e.g., a plastic or paper label). In some embodiments, liner 502 is dimensioned and arranged to receive a medicine bottle having a different shape, such as medicine bottle 104, and the like.

In some embodiments, liner 502 is dimensioned and arranged to provide additional assurance of attachment robustness to medicine bottle 104 for the duration of use by forming it from a material having a degree of elastomeric property. In some embodiments, an additional layer of elastomer material is disposed on the interior surface of liner 502 to provide higher friction and better grip to the medicine bottle.

Smart bottle 500 enables the filling of medicine bottle 104 with content 102 prior to being placed into liner 502. This affords such embodiments significant advantages, including:

easier sanitization for reuse because contact between the medicine and the liner is avoided; and use with medicine bottles having a shape that does not lend itself to insertion of an inside liner, such as a medicine bottle having a body that is wider than its neck region, such as medicine bottle 504.

It should be noted, however, that liner 502 can interfere with the visibility of information printed on a label that is often affixed to the outer surface of a medicine bottle. In some embodiments, therefore, the layout of electrodes 116 is arranged such that a region of medicine bottle 104 is left visible. In some embodiments, the printed label is placed on the receptacle instead of the medicine bottle. In some embodiments, receptacle 502 includes a substantially clear region that magnifies the surface of medicine bottle 104 when it is placed into the receptacle, thereby making it easier to read printed information on the medicine bottle.

Figure 6:
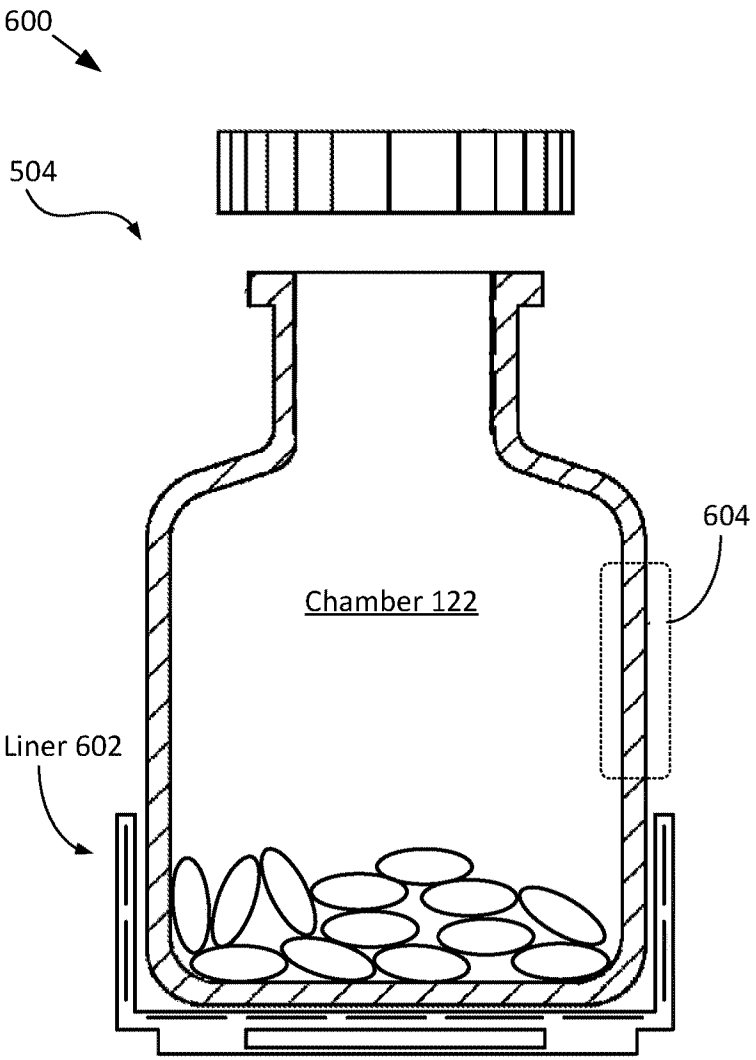
FIG. 6 depicts a schematic drawing of cross-sectional side view of a "smart" medicine bottle in accordance with a fourth alternative embodiment of the present invention.

FIG. 6 depicts a schematic drawing of cross-sectional side view of a "smart" medicine bottle in accordance with a fourth alternative embodiment of the present invention. Smart bottle 600 is analogous to smart bottle 500; however, liner 602 has a reduced height such that it surrounds only a lower portion of medicine bottle 504. As a result, label portion 604, located on the exterior surface of medicine bottle 504, is exposed and readable by the patient, caregiver, etc.

Figure 7:
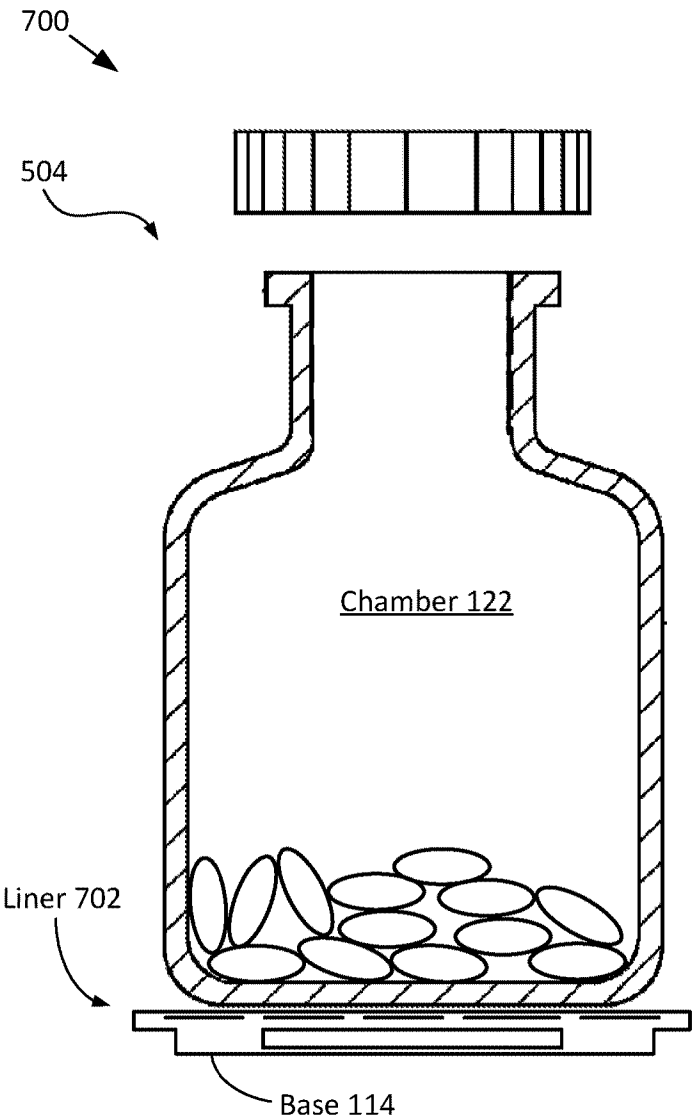
FIG. 7 depicts a schematic drawing of cross-sectional side view of a "smart" medicine bottle in accordance with a fifth alternative embodiment of the present invention.

FIG. 7 depicts a schematic drawing of cross-sectional side view of a "smart" medicine bottle in accordance with a fifth alternative embodiment of the present invention. Smart bottle 700 is analogous to smart bottle 500; however, liner 702 includes only base 114, upon which medicine bottle 504 rests.

It should be noted that even though each of the embodiments disclosed above comprise a liner that is distinct from the medicine bottle, in some embodiments, a liner is integrated with the medicine bottle to form a unitary body. In other words, in some embodiments, electrodes 116 and electronics 118 are integrated into the wall of the body of the medicine bottle. Although such embodiments benefit from the same features and capabilities of the liners described above, such integration would require a change to the manufacturing process of the medicine bottle to add the requisite process steps for fabrication. In some embodiments, a liner in accordance with the present invention is fused to the medicine bottle after each has been separately fabricated. By integrating the liner and the medicine bottle, the chain of custody of a medication is enabled, authentic and counterfeit medication can be differentiated, and theft is made more difficult.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus for monitoring a content of a chamber of a container, the apparatus comprising:

a liner that comprises a first plurality of electrodes that includes more than two electrodes, the liner being dimensioned and arranged to locate the first plurality of electrodes such that they are electrically coupled with the content; and electronic circuitry that is operative for performing a first measurement of a distribution of a first characteristic of the content via a technique selected from the group consisting of electrical capacitance tomography (ECT) and acoustic imaging, wherein the first characteristic is selected from the group consisting of permittivity and acoustic impedance wherein the first measurement includes:

(1) generating a plurality of stimulus signals, each stimulus signal of the plurality thereof being generated between a different pair of electrodes of the first plurality thereof;

(2) for each stimulus signal of the plurality thereof, measuring a response signal at each other electrode of the first plurality thereof to define a response-signal set, wherein the plurality of stimulus signals and the plurality of response-signal sets have a one-to-one correspondence; and (3) generating a map of the three-dimensional distribution of the first characteristic of the content within the chamber based on the plurality of stimulus signals and the plurality of response-signal sets.

2. The apparatus of claim 1 further comprising a processor operative for developing an image of the content based on the first measurement.

3. The apparatus of claim 1 wherein the stimulus signal is one of electric current and voltage, and wherein each response signal of the plurality of response-signal sets is the other one of electric current and voltage.

4. The apparatus of claim 1 wherein each stimulus signal is a first acoustic signal, and wherein each response signal of its respective response-signal set is a second acoustic signal that is based on the first acoustic signal and the content.

5. The apparatus of claim 1 wherein the electronic circuitry includes at least one of a wireless transmitter, a wireless receiver, and a wireless transceiver.

6. The apparatus of claim 1 wherein the liner and container are integrated to collectively define a unitary body.

7. The apparatus of claim 1 further comprising a label that includes printed information, wherein the liner and label are integrated.

8. The apparatus of claim 1 wherein the liner is configured to fit within the container such that the first plurality of electrodes is located within the chamber.

9. The apparatus of claim 1 wherein the liner includes at least one feature that projects from a surface of the liner, the at least one feature including at least one of the plurality of electrodes.

10. The apparatus of claim 9 wherein the at least one feature includes a pedestal.

11. The apparatus of claim 1 wherein the liner includes a around plane that is configured to function as an electrical shield for at least one electrode of the first plurality thereof.

12. The apparatus of claim 1 wherein the liner includes a reservoir that is operative for locating the container such that the first plurality of electrodes is located outside the chamber.

13. The apparatus of claim 12 wherein liner is configured to expose a portion of an exterior surface of the container.

14. The apparatus of claim 13 wherein the liner is configured to provide a magnified image of the portion.

15. The apparatus of claim 12 wherein liner comprises a first surface that is operative for conforming to the container when the container is located in the reservoir.

16. A method for monitoring a content of a chamber of a container, the method comprising:

(1) arranging the chamber and a liner that comprises a plurality of electrodes that includes more than two electrodes, the liner being configured to locate the plurality of electrodes such that they are electrically coupled with the content;

(2) generating a first map of a three-dimensional distribution of a first characteristic of the content within the chamber at a first time, wherein the first map is generated via a technique selected from the group consisting of electrical capacitance tomography (ECT) and acoustic imaging, wherein the first characteristic is selected from the group consisting of permittivity and acoustic impedance, and wherein the first map is generated by operations comprising;

(a) generating a first plurality of stimulus signals, each stimulus signal of the first plurality thereof being generated between a different pair of electrodes of the plurality thereof; and (b) for each stimulus signal of the first plurality thereof, measuring a response signal at each other electrode of the plurality thereof to define a response-signal set of a first plurality thereof, wherein the first plurality of stimulus signals and the first plurality of response-signal sets have a one-to-one correspondence;

wherein the first map is based on the first plurality of stimulus signals and the first plurality of response-signal sets; and (3) determining a first quantity of the content within the chamber at the first time based on the first map.

17. The method of claim 16 wherein the first characteristic is permittivity.

18. The method of claim 16 wherein the first characteristic is acoustic impedance.

19. The method claim 16 wherein each stimulus signal of the first plurality thereof is one of electric current and voltage and each response signal of the first plurality of response-signal sets is the other one of electric current and voltage.

20. The method of claim 16 wherein each stimulus signal of the first plurality thereof is a first acoustic signal, and wherein each response signal of its respective response-signal set of the first plurality thereof is a second acoustic signal that is based on the first acoustic signal and the content.

21. The method of claim 16 wherein the liner is provided such that the liner and container are integrated to collectively define a unitary body.

22. The method of claim 16 wherein the liner is provided such that it is integrated with a label that includes printed information.

23. The method of claim 16 wherein the liner is provided such that it is located within the chamber.

24. The method of claim 16 wherein the liner is provided such that it includes at least one feature that projects from a surface of the liner, the at least one feature including at least one of the plurality of electrodes.

25. The method of claim 24 wherein the at least one feature includes a pedestal.

26. The method of claim 16 wherein the liner is provided such that it includes a around plane that is configured to function as an electrical shield for at least one electrode of the plurality thereof.

27. The method of claim 16 wherein the liner is provided such that it includes a reservoir that is operative for locating the container.

28. The method of claim 16 further comprising (4) generating an output signal in response to a stimulus that is based on at least one of a temperature, a humidity, a mechanical shock, an access of the container, an identification code based on the content, and the geographic location of the container.

29. The method of claim 16 further comprising:

(4) generating a second map of the distribution of the first characteristic of the content at a second time, wherein the second map is generated via a technique selected from the group consisting of electrical capacitance tomography (ECT) and acoustic imaging, wherein the second map is generated by operations comprising;

(a) generating a second plurality of stimulus signals, each stimulus signal of the second plurality thereof being generated between a different pair of electrodes of the plurality thereof; and (b) for each stimulus signal of the second plurality thereof, measuring a response signal at each other electrode of the plurality thereof to define a response-signal set of a second plurality thereof, wherein the second plurality of stimulus signals and the second plurality of response-signal sets have a one-to-one correspondence;

wherein the second map is based on the second plurality of stimulus signals and the second plurality of response-signal sets; and (5) determining a second quantity of the content within the chamber at the second time based on the second map.

30. The method of claim 29 further comprising (6) generating an output signal based on at least one of the first quantity, the second quantity, the first time, and the second time.

31. The method of claim 29 wherein the output signal includes at least one indicator that is based on at least one of the state of the content at the second time, an environmental condition, and a difference in the content at the first and second times.

* * * * *